US008801236B2

(12) United States Patent
Hsieh et al.

(10) Patent No.: US 8,801,236 B2
(45) Date of Patent: Aug. 12, 2014

(54) LAMP

(75) Inventors: Yi-Chu Hsieh, New Taipei (TW); Hui-Feng Jen, New Taipei (TW); Che-Hsin Liao, New Taipei (TW); Jia-Yi Juang, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 89 days.

(21) Appl. No.: 13/483,065

(22) Filed: May 30, 2012

(65) Prior Publication Data

US 2013/0170229 A1 Jul. 4, 2013

Related U.S. Application Data

(60) Provisional application No. 61/582,399, filed on Jan. 1, 2012.

(51) Int. Cl.
*F21V 15/00* (2006.01)

(52) U.S. Cl.
USPC ..... 362/362; 362/382

(58) Field of Classification Search
USPC ..... 362/353, 362, 382, 418, 437, 438, 443
See application file for complete search history.

(56) References Cited

U.S. PATENT DOCUMENTS

2010/0321871 A1* 12/2010 Diebel et al. ..... 361/679.01

FOREIGN PATENT DOCUMENTS

| | | |
|---|---|---|
| TW | M332788 | 5/2008 |
| TW | M397481 | 2/2011 |
| TW | M412304 | 9/2011 |

* cited by examiner

*Primary Examiner* — Meghan Dunwiddie
(74) *Attorney, Agent, or Firm* — Jianq Chyun IP Office

(57) ABSTRACT

A lamp including a first case, a second case, a lamp bottom and a pair of friction units is provided. The second case has a first sidewall and a second sidewall perpendicularly to the first sidewall. The first sidewall has a first positioning portion extending along a normal direction to the first sidewall, and the second case is detachably assembled with the first case to form a case assembly having a first opening. The lamp bottom is embedded into the first opening. The lamp bottom has a second opening and a second positioning portion, wherein the second positioning portion is located on the path of the first positioning portion when the case assembly rotates relative to the lamp bottom. The friction units are disposed at opposing sides of the first opening and contact a portion of the lamp bottom embedded into the first opening.

9 Claims, 4 Drawing Sheets

LAMP

CROSS-REFERENCE TO RELATED APPLICATION

This application claims the priority benefit of U.S. provisional application Ser. No. 61/582,399, filed on Jan. 1, 2012. The entirety of the above-mentioned patent application is hereby incorporated by reference herein and made a part of this specification.

TECHNICAL FIELD

The disclosure relates to a lamp, and particularly relates to a lamp of which the case assembly thereof can rotate relative to the lamp bottom.

BACKGROUND

In daily life, people usually use lamps to provide light in indoor area in which light is faint. For example, in areas around a desk or a writing table, which requires sufficient light, using a desk lamp makes the environment brighter and allows users to read or work on the desk without worrying sight degeneration caused by insufficient light in their working environments.

The desk lamp above has a bottom of desk lamp, a lamp case, and a lamp bottom. In the conventional way of assembling a desk lamp, the lamp bottom and the lamp case are assembled together manually before screwing the lamp bottom into the bottom of the desk lamp. However, the light-emitting surface of the desk lamp after screwing the lamp bottom into the bottom of the desk lamp may not be set at the angle the users need. Under this circumstance, it requires to rework by removing the lamp bottom from the bottom of the desk lamp to re-adjust the initial position and assemble the desk lamp again. Therefore, the conventional way of assembling a desk lamp is not convenient for users.

SUMMARY

The disclosure provides a lamp, in which a case assembly thereof may rotate relative to a lamp bottom, so as to set the light-emitting surface at an angle users need.

The disclosure provides a lamp, comprising a first case, a second case, a lamp bottom and a pair of friction units, wherein the second case includes a first sidewall and a second sidewall perpendicularly connected to the first sidewall, and the first sidewall has a first positioning portion extending along a normal direction of the first sidewall, and the second case is detachably assembled with the first case to form a case assembly having a first opening. The lamp bottom is embedded into the first opening to be assembled with the case assembly. The lamp bottom has a second opening and a second positioning portion, wherein the second positioning portion is located on a rotation path of the first positioning portion when the lamp bottom rotates relative to the case assembly. The friction units is disposed at opposite sides of the first opening and is in contact with a portion of the lamp bottom embedded into the first opening.

In an embodiment of the disclosure, the first positioning portion is one of a convex rib and a stopping protrusion. The second positioning portion is the other of the convex rib and the stopping protrusion.

In an embodiment of the disclosure, the case assembly further comprises a pair of pillars configured on the first case or the second case. The pillars are configured in juxtaposition at opposite sides of the first opening, and the friction units are correspondingly configured on the pillars.

In an embodiment of the disclosure, the lamp further comprises a pair of locking elements penetrating through the friction units and locked into the case assembly.

In an embodiment of the disclosure, a material of the friction units is thermoset plastic or thermoplastic.

In an embodiment of the disclosure, the first sidewall has an internal surface, and the first positioning portion protrudes from the internal surface. The first sidewall further has a slot configured on the internal surface of the first sidewall, and the slot is located between the first positioning portion and the second sidewall.

In an embodiment of the disclosure, the first case has a first notch, and the second case has a second notch. In addition, the second notch and the first notch form the first opening together.

In an embodiment of the disclosure, the lamp bottom includes a body and a bottom, wherein the body has a groove, the bottom is detachably assembled to the groove of the body, and is suitable to be embedded to the first opening, wherein the second opening and the second positioning portion are disposed on the body, and the body has a portion of the lamp bottom embedded to the first opening.

Based on above, since the lamp bottom and the case assembly are configured to each other, the efficiency that the lamp bottom and the case assembly rotate to each other can be achieved in the lamp of the disclosure. When the lamp bottom is screwed into a bottom of a desk lamp but the light-emitting surface does not meet users' need, users only have to rotate the case assembly relative to the lamp bottom to adjust the angle of the light-emitting surface of the case assembly relative to users. In addition, the positioning portions are respectively disposed at the case assembly and lamp bottom, so as to further limit the angle that the case assembly rotates relative to the lamp bottom as well as limiting the adjustment of the angle of the light-emitting surface to users to be minor adjustments. Disposing the fractioning units makes users harder to rotate the case assembly relative to the lamp bottom, and prevents breakage of the positioning portions caused by inappropriate force applied by users.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

Figure 1:
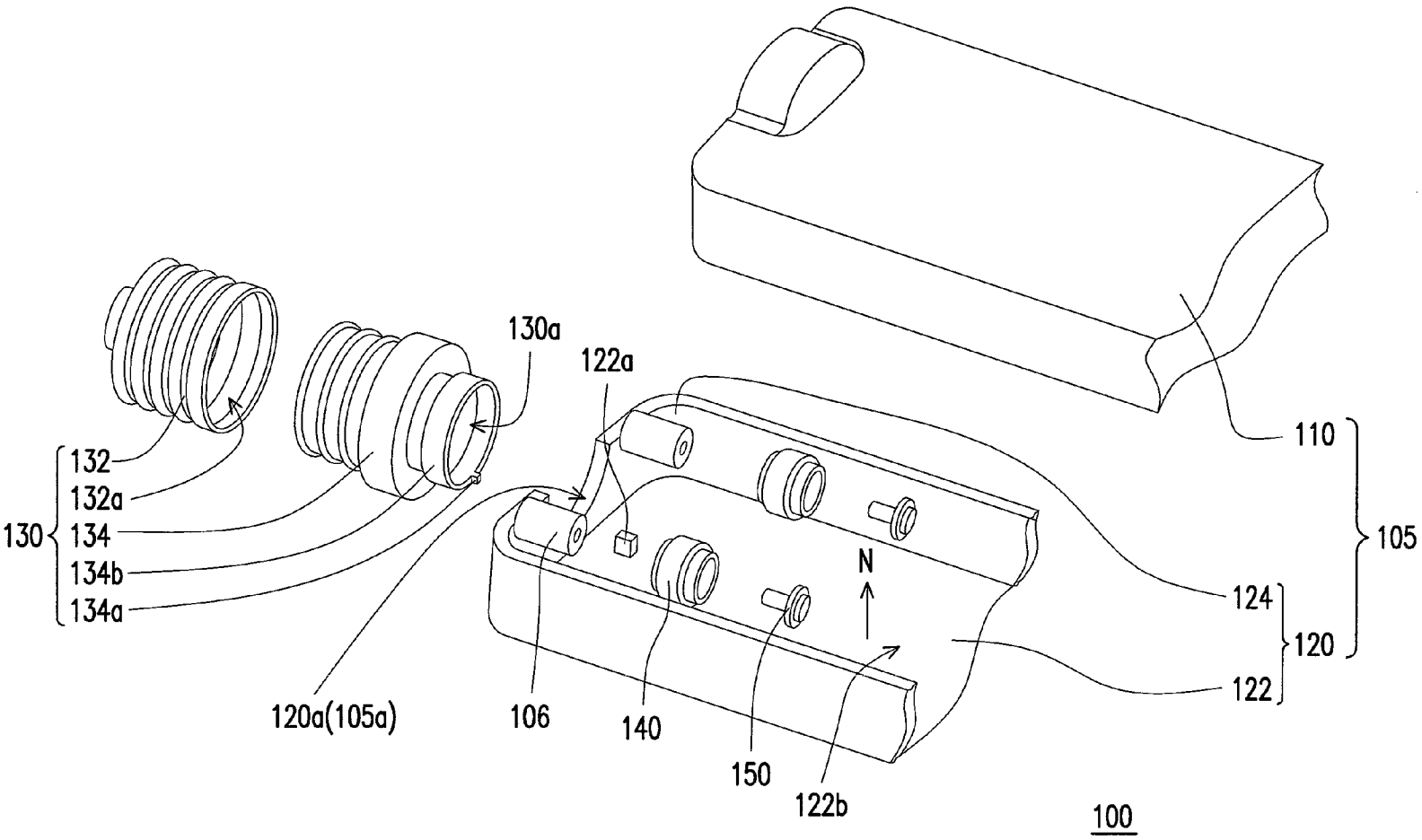
FIG. 1 is a decomposition schematic diagram of a lamp according to an embodiment of the disclosure.
Figure 2:
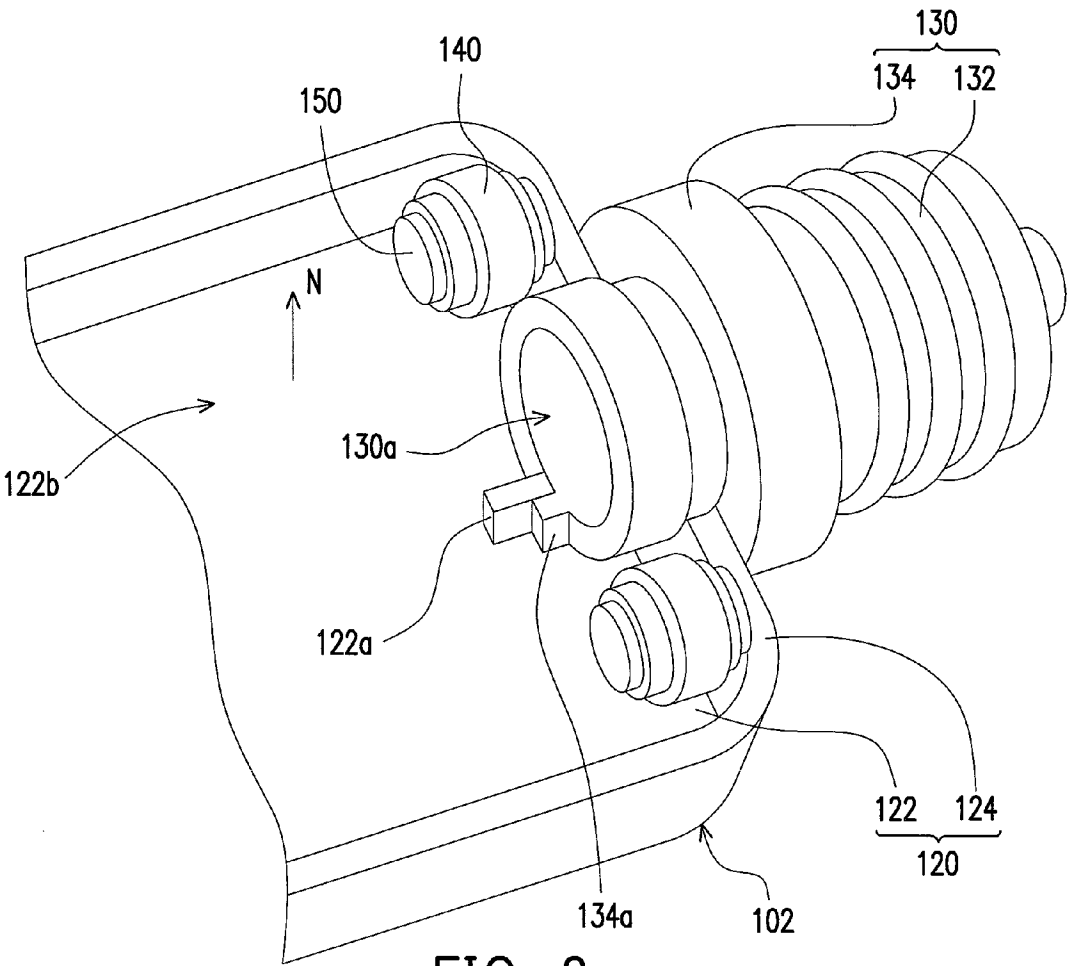
FIG. 2 is schematic diagram illustrating a portion of the lamp of FIG. 1.

FIG. 1 is a decomposition schematic diagram of a lamp according to an embodiment of the disclosure, and FIG. 2 is schematic diagram illustrating a portion of the lamp of FIG. 1. Please refer to FIGS. 1 and 2 together. A lamp 100 of the embodiment includes a first case 110, a second case 120, a lamp bottom 130, and a pair of friction units 140, wherein the second case 120 includes a first sidewall 122 and a second sidewall 124 that is perpendicularly connected to the first side wall 122, and the first side wall 122 has a first positioning portion 122*a* extending along a normal direction N of the first side wall 122, while the second case 120 is detachably assembled with the first case 110 to form a first case assembly 105 having a first opening 105*a*. The lamp bottom 130 is embedded into the first opening 105*a* to be assembled together with the case assembly 105. The lamp bottom 130 has a second opening 130*a* and a second positioning portion 134*a*, wherein the second positioning portion 134*a* is configured on a sidewall (not shown) of the second opening 130*a* and on a rotation path of the first positioning portion when the lamp bottom 130 and the case assembly 105 rotate relative to each other. The friction units 140 are disposed at opposing sides of the first opening 105*a* and are in contact with a portion 134*b* of the lamp bottom 130 that is embedded into the first opening 105*a*. The first positioning portion 122*a* and the second positioning portion 134*a* are configured to limit an angle of rotation of the case assembly 105 relative to the lamp bottom 130, and the friction units 140 are configured to increase friction force between the case assembly 105 and the lamp bottom 130, such that users have to apply force to a certain degree to rotate the case assembly 105 relative to the lamp bottom 130, so as to avoid rotation of the case assembly 105 relative to the lamp bottom 130 caused by unexpected shaking or collision.

Figure 3:
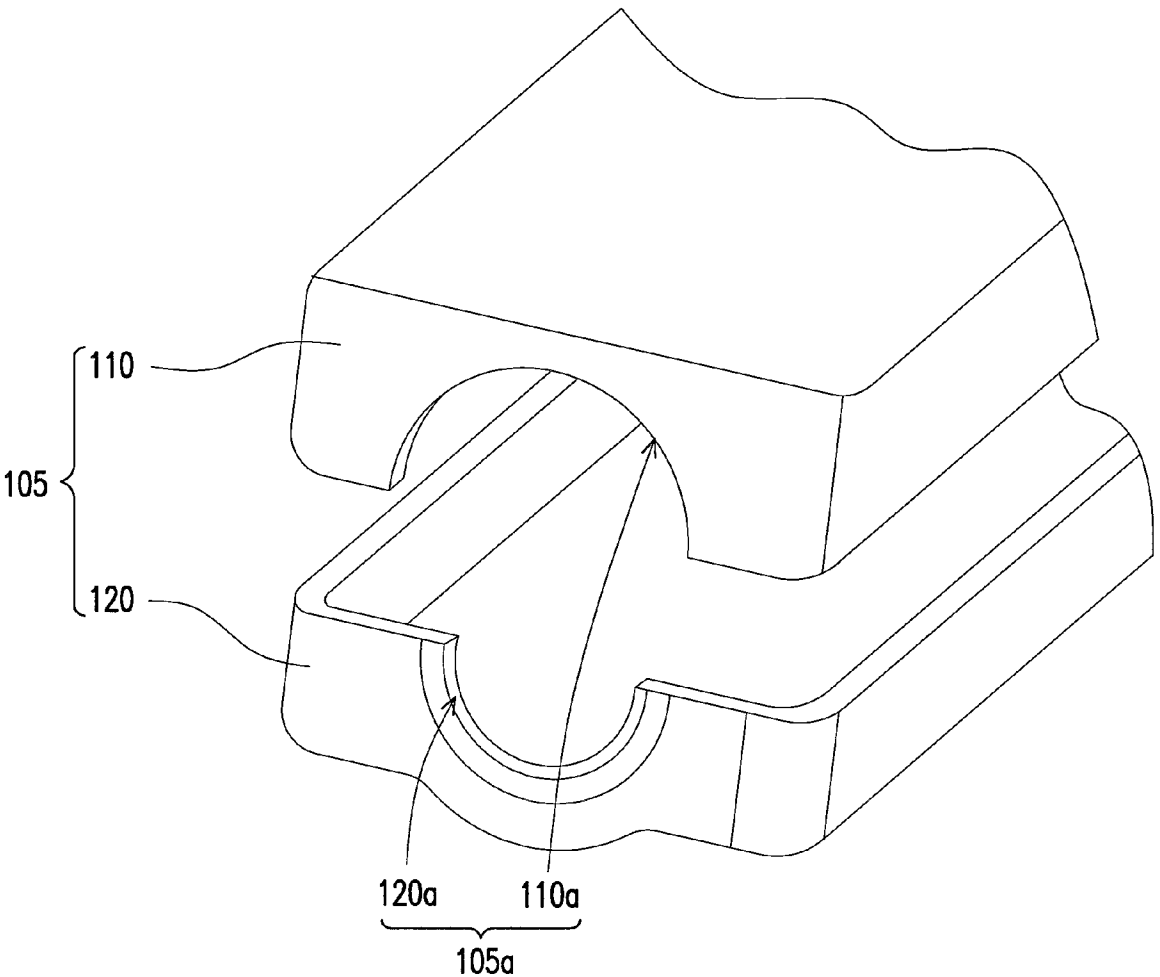
FIG. 3 is a decomposition schematic diagram of a case assembly.
Figure 4:
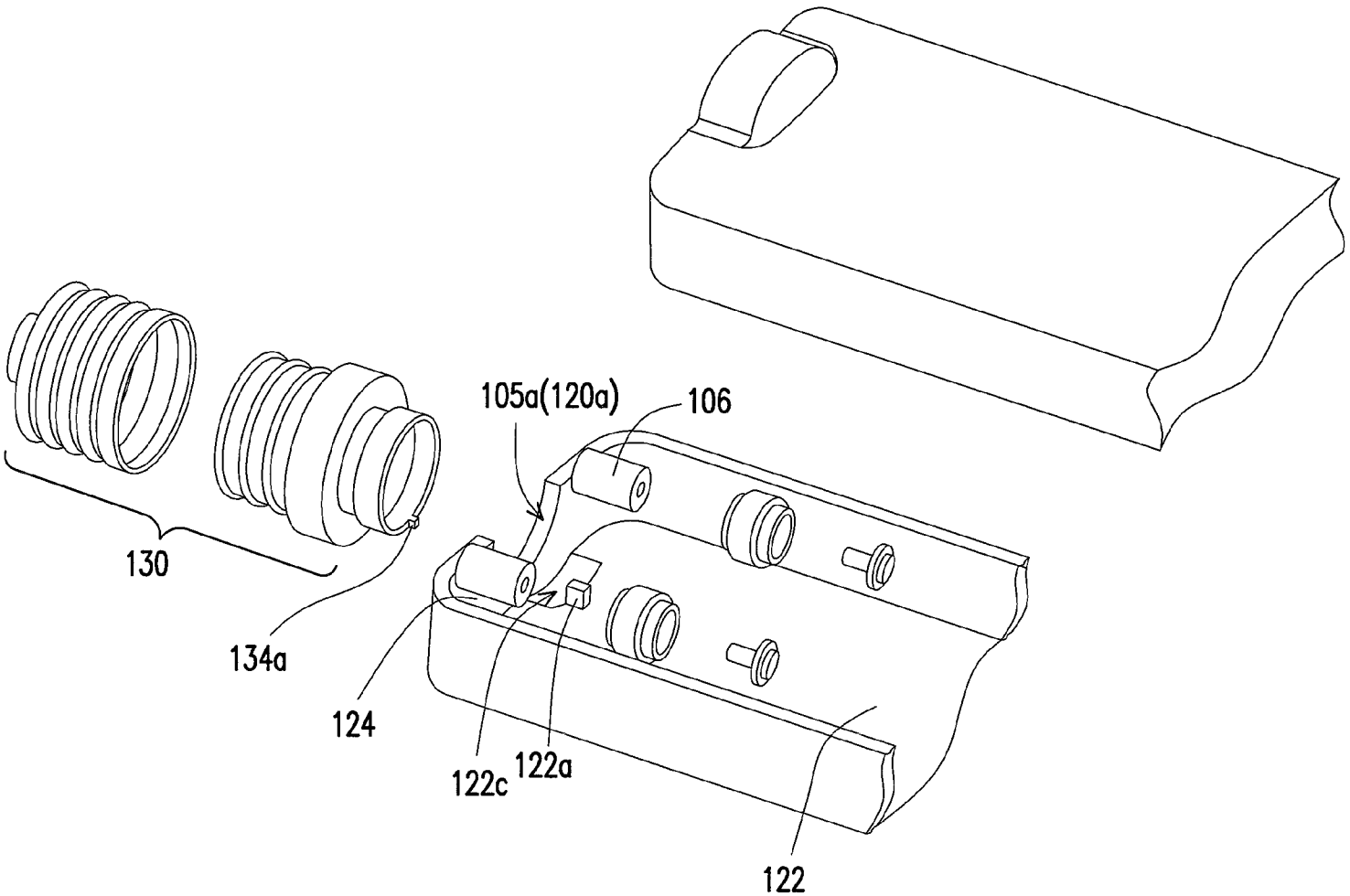
FIG. 4 is a schematic diagram illustrating a slot between the first positioning portion of the first sidewall and the second sidewall.

FIG. 3 is a decomposition schematic diagram of a case assembly. Please refer to FIGS. 1, 2, and 3 together. The first case 110 of this embodiment has a first notch 110*a*, the second case 120 has a second notch 120*a*, and the second notch 120*a* and the first notch 110*a* together form the first opening 105*a*. In addition, the first sidewall 122 of the second case 120 has an internal surface 122*b*, and the first positioning portion 122*a* extends along the normal direction N and protrudes from the internal surface 122*b* toward the first case 110. In this embodiment, the internal surface 122*b* is a flat surface, and a distance between the internal surface 122*b* and the second notch 120*a* suffices to keep the portion 134*b* of the lamp bottom 130 embedded in the first opening 105*a* from contacting with the internal surface 122*b*. In another embodiment, a slot 122*c* may further be disposed on the internal surface 122*b* of the first sidewall 122. In addition, the slot 122*c* is disposed between the first positioning portion 122*a* and the second sidewall 124, and is configured to provide space to prevent the portion 134*b* of the lamp bottom 130 embedded in the first opening 105*a* from contacting with the internal surface 122*b*, as illustrated in FIG. 4.

Please refer to FIGS. 1, 2, and 3 again. The lamp bottom 130 includes a bulk 132 and a bottom 134, wherein the bulk 132 has a groove 132*a*, and the bottom 134 is detachably assembled to the groove 132*a* of the bulk 132, and is suitable to be embedded in the first opening 105*a*, wherein the second opening 130*a* and the second positioning portion 134*a* are disposed at the bottom 134, and the bottom 134 has the portion 134*b* embedded in the first opening 105*a*. More specifically, both the bulk 132 and the bottom 134 have a thread, with which the bottom 134 is screwed into the groove 132*a* of the bulk 132, so as to be assembled together with the bulk 132.

Further, the first positioning portion 122*a* may be a convex rib, and the second positioning portion 134*a* may be a stopping protrusion. However, the disclosure is not limited thereto. Shapes and types of the first positioning portion 122*a* and the second positioning portion 134*a* may be modified according to practical requirements, as long as the efficiency of positioning can be achieved. In addition, the case assembly 105 is further configured with a pair of pillars 106 that are configured in juxtaposition at opposing sides of the first opening 105*a*. The friction units 140 are correspondingly configured on the pillars 106. Although this embodiment is exemplified by configuring the pillars 106 on the second case 120, people having ordinary skill in the art may naturally configure the pair of pillars 106 on the first case 110 based on their needs while the efficiency that the friction units 140 are disposed on the pillars 106 and are in contact with the lamp bottom 130 can be achieved. A material of the friction units 140 of this embodiment is thermoset plastic or thermoplastic, depending on practical requirements.

Moreover, in this embodiment, to increase the assembling stability of the friction units 140 on the pillars 106, the lamp 100 may further include a pair of locking elements 150, which penetrate through the friction units 140 and lock into the pillars 106. In other embodiments that are not illustrated, the friction units 140 may be assembled onto the pillars 106 by tight-fitting or other means, according to practical needs. Alternatively, if the pillars 106 are not disposed, the locking elements 150 may be used to penetrate through the friction units 140 and lock into the case assembly 105.

Please still refer to FIGS. 1, 2, and 3 together. After the lamp bottom 130 and the case assembly 105 are assembled together, the portion 134*b* of the bottom 134 of the lamp bottom 130 embedded into the first opening 105*a* is in contact with the friction units 140. When the lamp bottom 130 of the lamp 100 is screwed into a bottom of a desk lamp (not shown), an angle of a light-emitting surface 102 of the lamp 100 relative to users may be influenced by an initial position of assembling. When the angle of the light-emitting surface 102 of the lamp 100 relative to users requires significant adjustment, it is difficult not to detach the lamp 100 from the bottom of the desk lamp to re-adjust the initial position and re-assemble the desk lamp. What should be noted is that, in the lamp 100 of this embodiment, when the angle of the light-emitting surface 102 of the lamp 100 relative to users only requires a minor adjustment, users may rotate the case assembly 105, such that the case assembly 105 rotates relative to the lamp bottom 130, so as to adjust the light-emitting surface 102 of the lamp 100 relative to users.

More specifically, when users apply force to rotate the case assembly 105 relative to the lamp bottom 130, the first positioning portion 122*a* configured on the first sidewall 122 of the second case 120 and the second positioning portion 134*a* configured on the bottom 134 of the lamp bottom 130 are used to limit the angle of rotation of the case assembly 105 relative to the lamp bottom 130, to prevent entanglement and even breakage of the wire used for power supply caused by unlimited angle of rotation of the case assembly 105 relative to the lamp bottom 130.

Furthermore, since the friction units 140 are in contact with the portion 134*b* of the lamp bottom 130 embedded into the first opening 105*a*, users have to apply force to a certain degree to rotate the case assembly 105 relative to the lamp bottom 130 due to the friction force between the friction units 140 and the portion 134*b* of the lamp bottom 130 embedded into the first opening 105*a*. If the friction units 140 are not configured, any unexpected shaking or collision may cause rotation of the case assembly 105 relative to the lamp bottom 130 and change the angle of the light-emitting surface 102 of the lamp 100 relative to users. In brief, configuration of the fractioning units 140 effectively sets the case assembly 105 at an angle relative to the lamp bottom 130, so as to meet the expectation of users when using.

Based on above, since the lamp bottom and the case assembly are configured to each other in the lamp of the disclosure, an efficiency that the lamp bottom and the case assembly rotate with each other can be achieved. When the light-emitting surface of the lamp after the lamp bottom is screwed in the bottom of the desk lamp does not fit the expectation of users, users only have to rotate the case assembly relative to the lamp bottom to adjust the angle of the light-emitting surface relative to users. Further, the positioning portions are respectively configured on the case assembly and the lamp bottom, so as to further limit the angle of relative rotation between the lamp bottom and the case assembly. Moreover, configuration of the friction units not only prevents the positioning portions from breakage due to inappropriate force applied by users with the help of the friction force between the friction units and the lamp bottom, but remains the case assembly at the expected angle after users stop applying force when their needs are met.

Although the disclosure is described with the embodiments above, the disclosure is not limited thereto. It will be apparent to those skilled in the art that various modifications and variations can be made to the structure of the disclosed embodiments without departing from the scope or spirit of the disclosure. Therefore, the scope of the disclosure is defined in the claims below.

What is claimed is:

1. A lamp, comprising:

a first case;

a second case, including a first sidewall and a second sidewall, wherein the second sidewall is perpendicularly connected to the first sidewall, and the first sidewall has a first positioning portion, which extends along a normal direction of the first sidewall, and the second case is detachably assembled with the first case to form a case assembly that has a first opening;

a lamp bottom, which is embedded into the first opening to be assembled with the case assembly, and the lamp bottom has a second opening and a second positioning portion, wherein the second positioning portion is located on a rotation path of the first positioning portion when the case assembly rotates relative to the lamp bottom, wherein the lamp bottom includes:

a bulk having a groove; and a bottom, which is detachably assembled to the groove of the bulk and is suitable to be embedded into the first opening, wherein the second opening and the second positioning portion is disposed on the bottom; and a pair of friction units, which are disposed at two opposite sides of the first opening and is in contact with a portion of the lamp bottom embedded into the first opening.

2. The lamp as claimed in claim 1, wherein the first positioning portion is one of a convex rib or a stopping protrusion, and the second positioning portion is the other of the convex rib or the stopping protrusion.

3. The lamp as claimed in claim 1, wherein the case assembly further comprises a pair of pillars disposed on the first case or the second case and configured in juxtaposition at opposite sides of the first opening, and the friction units are correspondingly configured on the pair of pillars.

4. The lamp as claimed in claim 1, further comprises a pair of locking elements penetrating through the friction units and locked into the case assembly.

5. The lamp as claimed in claim 1, wherein a material of the friction units is thermoset plastic or thermoplastic.

6. The lamp as claimed in claim 1, wherein the first sidewall has an internal surface, and the first positioning portion protrudes from the internal surface.

7. The lamp as claimed in claim 6, wherein the first sidewall further comprises a slot configured at the internal surface and located between the first positioning portion and the second sidewall.

8. The lamp as claimed in claim 1, wherein the first case has a first notch, the second case has a second notch, and the first notch and the second notch together form the first opening.

9. The lamp as claimed in claim 1, wherein the bottom has the portion of the lamp bottom embedded into the first opening.

* * * * *